US005203627A

United States Patent [19]

Kira

[11] Patent Number: 5,203,627

[45] Date of Patent: Apr. 20, 1993

[54] GARDEN LAMP HOUSING

[75] Inventor: Hiroshi Kira, Westlake Village, Calif.

[73] Assignee: Lumiere Design & Manufacturing, Inc., Westlake Village, Calif.

[21] Appl. No.: 877,976

[22] Filed: May 4, 1992

[51] Int. Cl.[5] ..... F21V 21/00

[52] U.S. Cl. ..... 362/374; 362/285; 362/293; 362/310; 362/375; 362/455

[58] Field of Search ..... 362/285, 293, 307, 310, 362/362, 374, 375, 455, 223, 277, 319

[56] References Cited

U.S. PATENT DOCUMENTS

| | | | |
|---|---|---|---|
| D. 316,452 | 4/1991 | Kira | D26/68 |
| D. 316,459 | 4/1991 | Kira | D26/68 |
| D. 316,758 | 5/1991 | Kira | D26/68 |
| D. 317,661 | 6/1991 | Kira | D26/68 |
| D. 318,136 | 7/1991 | Kira | D26/68 |
| 4,523,263 | 6/1985 | Poyer | 362/374 X |
| 4,667,278 | 5/1987 | Poyer | 362/375 X |

*Primary Examiner*—Stephen F. Husar
*Attorney, Agent, or Firm*—Wagner & Middlebrook

[57] ABSTRACT

A lighting fixture designed particularly for exterior garden, walkway or yard lighting. The housing is in the form of a pair of mating ceramic housing parts which form a light emitting opening. The ceramic housing parts include integral groove for positioning a lens or transparent opening closure, filters for changing the color of the light emitted and a lamp-reflector assembly. The ceramic housing provides a virtually moisture impervious dielectric housing which includes, as integral parts of the housing, all of the necessary functions except fasteners.

12 Claims, 1 Drawing Sheet

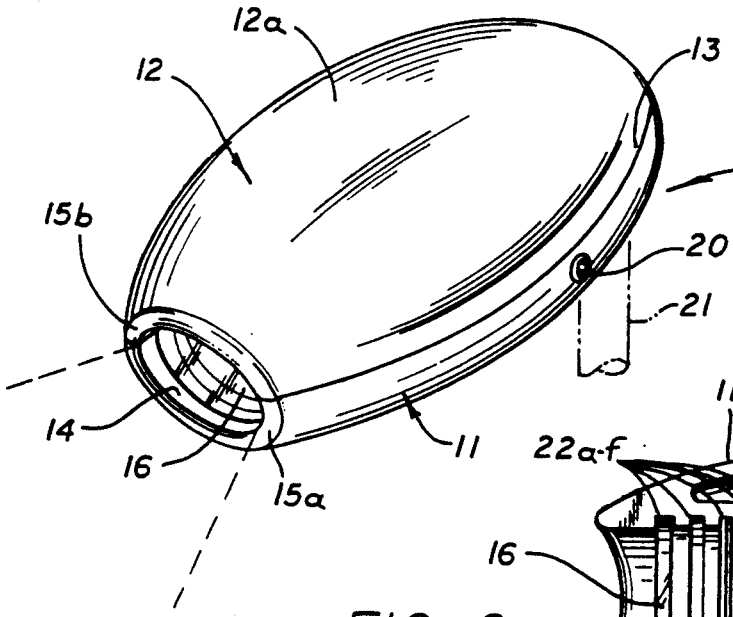
FIG. 1
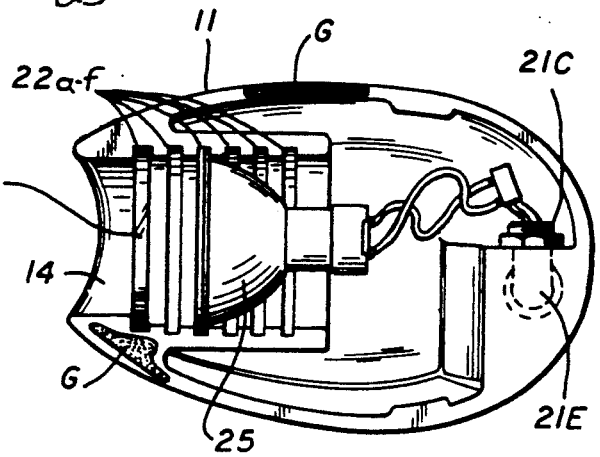
FIG. 2
FIG. 3
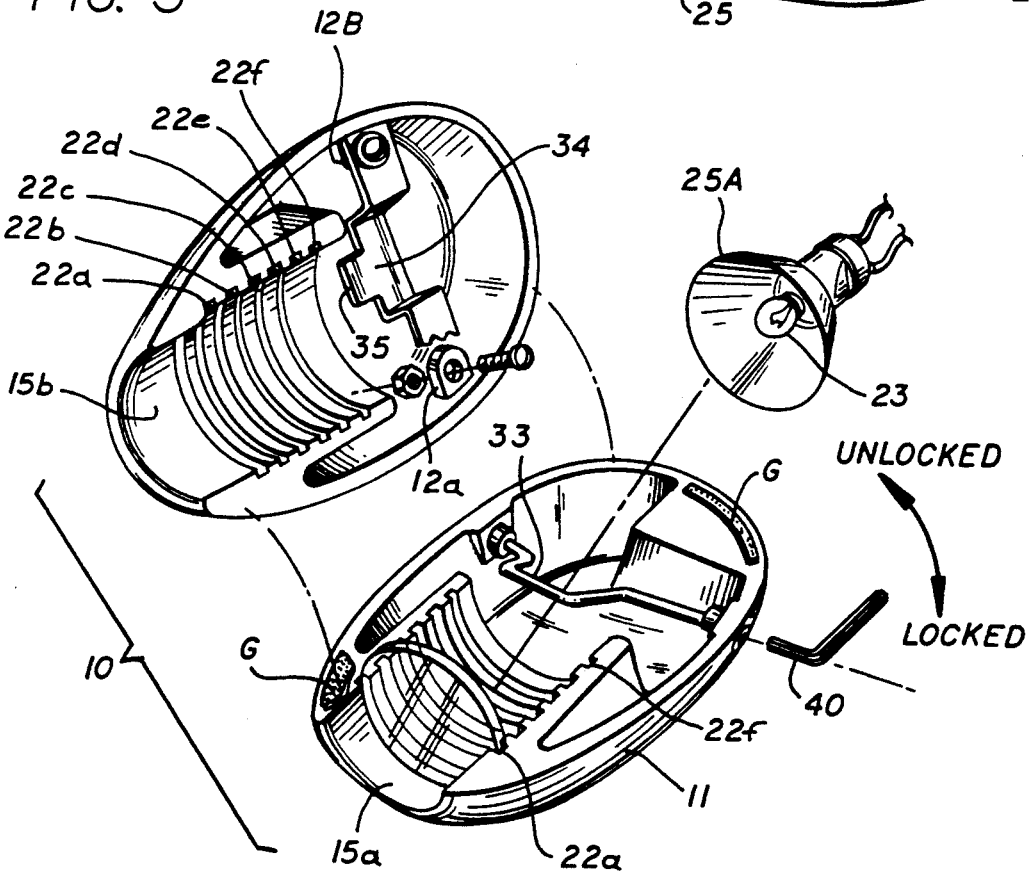

GARDEN LAMP HOUSING

BACKGROUND OF THE INVENTION

The field of outdoor lighting and, particularly, garden or yard lighting has developed through the years to the stage where outdoor lights, particularly those mounted in a garden or yard or along a walk, provide not only accent and safety lighting but add to the appearance of the yard or garden.

Early designs of pagoda style enclosures powered by low voltage systems have assumed an important part of yard decor. I have designed a number or ornamental housings for yard or garden lighting and examples are found in the following patents:

U.S. Pat. No. Des. 318,136
U.S. Pat. No. Des. 316,758
U.S. Pat. No. Des. 317,661
U.S. Pat. No. Des. 316,452
U.S. Pat. No. Des. 316,459

The foregoing patents can well be described as contemporary styling and have been well received for their beauty as well their function. Yard or garden fixtures typically employ a base, often of aluminum or other metal, with a weather resistent surface, some form of water resistent or sealed transparent lens or housing part and often a cover or light reflector for deflecting light downwards the ground surrounding the fixture. Typically a socket will be contained within the housing suitable insulators for a low voltage wire which is conducted into the housing via a conduit underground or surface laid wiring from a step down transformer connected to the house alternating current supply. Sometimes lens or color filters are present in addition to the transparent housing for either controlling or directing a light beam or changing its color.

In each of the designs discussed above, the fixture is itself distinct in appearance and appears as a decor item in its own right in the garden or yard.

I have felt often there is a need for a yard or garden fixture which is fully functional, permanent and yet blends unobtrusively into the garden or decor.

SUMMARY OF THE INVENTION

Faced with this state of the art and recognizing the need for such unobtrusive and attractive fixtures, it appeared to me that a ceramic housing can meet the needs of providing a permanently environmentally stable, attractive, yet unobtrusive, fixture body and at the same time, provide the necessary electrical insulation and physical mounting of lens and lamp without the need for numerous parts which add to the cost and reduce the reliability.

I have invented a ceramic bodied fixture having at least one light emitting opening and openable to expose the lamp, a lens, color filters, if desired, and employing basically just two ceramic parts somewhat like a clam shell but sealed together to enclose a cavity having one or more recesses to hold a lamp in its base with sufficient clearance for its power wires, holders for a lens and holders for repositioning the lamp or for filters. All of the lamp filter and lens positioning devices are integral with the housing so all of the parts normally required to provide those functions are provided by the housing members themselves.

The housing need only have one or more light emitting openings and an opening for receiving the power leads.

In one embodiment an interior locking mechanism is accessed through a side opening. Other types of closures such as threaded fasteners may be used.

DESCRIPTION OF THE DRAWING

This invention may be more clearly understood from the following detailed description and by reference to the drawing in which:

FIG. 1 is a perspective view of a garden lamp housing of this invention showing typical light beam pattern in dashed lines;

FIG. 2 is a top plan view of the housing of this invention with the cover removed;

FIG. 3 is an exploded view showing the housing cover and lamp removed.

DESCRIPTION OF THE PREFERRED EMBODIMENTS

This invention in its preferred embodiment may be seen in FIGS. 1-3 as a garden or yard lamp housing generally designated 10 including a base 11 and cover 12 having a sealed joint 13 therebetween. They define a light emitting opening 14 in its generally angular front face made up of continuous planar surfaces 15A and 15B. Seen within the light emitting opening is a transparent cover or lens 16 which acts as a weather seal. A pair of dashed lines denote the perimeter of the light beams with a lamp and reflector combination located at one of several selectable positions within the housing. A side opening 20 in the base receives a locking mechanism illustrated in this embodiment as a hex head lock 31 better seen in FIG. 3. For purposes of illustrating a typical mounting, a conduit 21 is shown in dashed lines. The conduit typically terminates in an 90 degree elbow 21E of FIG. 2 and a conventional connector 21C. The housing of this invention may be mounted in virtually any manner to allow mechanical support for the housing and act as a conduit for the entrance of power leads for the lamp contained within the housing.

The housing base 11 and cover 12 are of ceramic material such as porcelain with their exterior surfaces 11A and 12A being ornamentally treated in any desired treatment within the broad variety of surface treatments found in ceramic. We have found that a grey stone-like finish can blend beautifully with a garden which employs grey stones as garden accents. Bright and colorful glazes are equally usable on this housing. Preferably the base 11 and cover 12 have the same glaze in order to provide an unobtrusive natural appearing shape and coloration.

As may be seen in FIGS. 2 and 3, the base 11 and cover 12 are separated by a thin gasket G, preferably of Neoprene, the edge of which appears in FIG. 1 and a portion thereof appears in FIG. 3. The gasket conforms to the mating surfaces of the housing parts and provides an effective weather seal. The lens 16 is shown in FIGS. 2 and 3 as positioned in a groove 22A of the series of annular grooves 22A through 22F located in the barrel-like light emitting opening 14. The diameter of the grooves 22A through F and the lens 16 diameter are selected to match the edge ring diameter of the series of commercially available lamps, for example, MR-11 and MR-16 lamps 23 having an integral or preassembled reflector 25 with its edge ring 25A. The series of grooves 22A through F allow the lamp reflector assembly 25 to be positioned in any of six different longitudinal positions depending upon the lighting effect sought. The innermost positions 22E and 22F provide more subdued lighting in that the lamp itself is hardly visible in any but a direct view. The grooves 22B through 22E may also be used for one or more colored filters in order to obtain different color effects.

It is desired that the housing appears as natural as possible, but that it may be serviced easily by removal of the cover 12 without disturbing the electrical connection or the mechanical mounting of the fixture. It is also desired that it be reasonably secure to avoid opening by vandals.

I have found that a hex head operated latch mechanism located in the base 11 is effective to allow opening and closing. It involves a U-shaped wire hook 33 journaled in openings 30 and 31 with the hex head 20 exposed to allow a 45 to 90 degree turn in the wire and release or locking of the cover. The cover 12 includes a locking strap 34 which is secured to a pair of internal lugs 12*a* and 12*b*. The strap 34 includes an offset portion with a tab 35 which extension provides a degree of resilience as does the locking wire so that little strain is placed upon the ceramic parts in the locking or unlocking operation. Other types of lock mechanisms such as screw fasteners extending from the bottom of the base 11 up into mating threaded recesses in the cover 12 may be used. The locking mechanism of FIG. 3 is preferred since it has no removable parts and uses a standard tool found in maintenance personnel tool boxes, namely, a series of hex wrenches. In the position shown in FIG. 3, the locking mechanism is unlocked and when the cover 12 is replaced on the base 11 and the hex wrench 40 inserted in the hex fitting 20 and turned 45 to 90 degrees downward, the cover is securely locked in place. The offset portion of strap 34 provides clearance for the lamp 23 and reflector 25.

As may be seen, the two ceramic housing parts provide an ornamental exterior, weather protection, define a light emitting opening, position lens filters and the lamp with no other parts required apart from the seal and locking mechanism or fasteners. Ceramics, such as porcelain, have extremely effective dielectric properties and when glazed are virtually non-absorbent of moisture and can last for centuries. I have found that glazing the interior as well as the exterior is extremely practical in our invention and provides the same non-moisture absorbing characteristic of porcelain inside as well as outside. I have also eliminated the numerous metal parts commonly found in garden or yard fixtures. The only metal parts present in my fixture are in the locking mechanism which is totally within the sealed structure with the exception of the hex head 20 and, consequently, is not subject to significant aging or rusting, as in the case of most garden fixtures. It is within the contemplation of this invention that the plate 34 be made integral with the housing cover 12 in the form of a transverse rib and lip. In such case, the plate and its fasteners, as well as the tabs 12*a* and 12*b*, may be eliminated and the housing is given additional strength.

Altogether, I have provided an extremely simple, rugged, attractive lamp housing which allows adjustability of lamps and filters, and weather resistance.

The above described embodiments of the present invention are merely descriptive of its principles and are not to be considered limiting. The scope of the present invention instead shall be determined from the scope of the following claims including their equivalents.

I claim:

1. A lighting fixture comprising a pair of mating ceramic parts defining an exterior housing, said housing parts including integral lamp and lens holders, and means defining an opening;

means for securing the housing parts together with said integral lamp and lens holders supporting a lamp and lens with said lamp directed to issue light from said opening; and an additional opening in one of said housing parts for allowing the passage of power leads from the exterior of said housing into the lamp.

2. A combination in accordance with claim 1 wherein said lamp and lens holders comprise grooves in the internal surface of said housing parts to receive the edge of a lamp reflector and the edge of a lens.

3. A combination in accordance with claim 1 wherein said lamp and lens holder comprise a series of aligned grooves dimensioned to receive either lens or a portion of the lamp.

4. A combination in accordance with claim 3 wherein said grooves are at least three in number whereby the lens or the lamp may be selectively positioned in more than one location or a filter may be positioned therein.

5. A combination in accordance with claim 1 wherein said lighting fixture is elongated and divided generally along the longitudinal median of the completed housing.

6. A combination in accordance with claim 1 wherein said housing is generally egg shaped with an angular generally planar surface at one end therein and wherein the light emitting opening is located in the angular end surface whereby part of the angular end surface on one housing part acts as a brow for the light opening.

7. A lighting fixture comprising an elongated housing including a pair of housing parts having mating surfaces and defining an internal cavity for holding a light source;

said housing including a light emitting opening generally at one end thereof and a passageway from the interior of the housing to said light emitting opening;

said passageway being generally circular and including a plurality of annular grooves in the wall thereof;

at least one of said grooves being dimensioned to receive a transparent closure for said light emitting opening and a second of said grooves being dimensioned to receive and position a lamp assembly for directing light from said lamp assembly through said light emitting opening; and means for securing said housing parts together.

8. A combination in accordance with claim 7 wherein said housing parts are ceramic.

9. A combination in accordance with claim 7 wherein said housing parts divides said internal cavity substantially in half and said housing parts each include substantially one half of the perimeter of said annular grooves to allow both of said housing parts to provide support for said light emitting opening closure and said lamp assembly.

10. A combination in accordance with claim 7 wherein said grooves number at least three whereby said lamp assembly may be positioned in at least two different longitudinal positions.

11. A combination in accordance with claim 7 wherein one of said housing parts includes an opening therethrough for the passage of power leads into the interior of said housing.

12. A combination in accordance with claim 7 including a transparent closure positioned in one of said grooves to close said housing and a lamp reflector assembly having and edge rim on said reflector;

said grooves dimensioned to receive the edge rim of said reflector and position said lamp-reflector assembly in said housing with the lamp directed toward said light emitting opening.

* * * * *